US010433082B2

(12) United States Patent
Vonlanthen et al.

(10) Patent No.: US 10,433,082 B2
(45) Date of Patent: Oct. 1, 2019

(54) FITTING METHOD FOR A BINAURAL HEARING SYSTEM

(71) Applicant: SONOVA AG, Staefa (CH)

(72) Inventors: Andi Vonlanthen, Oberrohrdorf (CH); Volker Kuehnel, Mannedorf (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/320,093

(22) PCT Filed: Jul. 26, 2016

(86) PCT No.: PCT/EP2016/067786

§ 371 (c)(1),
(2) Date: Jan. 23, 2019

(87) PCT Pub. No.: WO2018/019363

PCT Pub. Date: Feb. 1, 2018

(65) Prior Publication Data

US 2019/0253818 A1 Aug. 15, 2019

(51) Int. Cl.
*H04R 25/00* (2006.01)

(52) U.S. Cl.
CPC ..... *H04R 25/70* (2013.01); *H04R 25/552* (2013.01); *H04R 25/554* (2013.01)

(58) Field of Classification Search
CPC ..... H04R 25/70; H04R 25/552; H04R 25/554
See application file for complete search history.

(56) References Cited

U.S. PATENT DOCUMENTS

| | | | | |
|---|---|---|---|---|
| 10,158,956 | B2 * | 12/2018 | Theill | A61B 5/123 |
| 2010/0111338 | A1 | 5/2010 | Ypma et al. | |
| 2011/0249839 | A1 | 10/2011 | Mindlin et al. | |
| 2012/0243693 | A1 | 9/2012 | Paludan-Miller et al. | |
| 2014/0307903 | A1 | 10/2014 | Fichtl | |
| 2014/0309549 | A1 * | 10/2014 | Selig | H04R 1/1041 600/559 |
| 2018/0035216 | A1 * | 2/2018 | Van Hasselt | H04R 25/505 |

FOREIGN PATENT DOCUMENTS

| | | |
|---|---|---|
| EP | 2635046 | 9/2013 |
| WO | 2009/144056 | 12/2009 |
| WO | 2016/004970 | 1/2016 |

OTHER PUBLICATIONS

International Search Report received in PCT Patent Application No. PCT/EP2016/067786, dated Feb. 20, 2017.

* cited by examiner

*Primary Examiner* — Andrew L Sniezek
(74) *Attorney, Agent, or Firm* — ALG Intellectual Property, LLC

(57) ABSTRACT

There is provided a method for fitting of a binaural hearing system comprising a first hearing device and a second hearing device to a patient suffering from an asymmetric hearing loss for first time use, wherein the difference in hearing loss between the two ears is at least 5 dB on average in a main frequency range between 500 Hz and 4 kHz.

15 Claims, 3 Drawing Sheets

FITTING METHOD FOR A BINAURAL HEARING SYSTEM

The invention relates to a method for fitting of a binaural hearing system comprising a first hearing device and a second hearing device to a patient suffering from an asymmetric hearing loss.

The purpose of a fitting process is to adjust the audio signal processing parameters of a hearing device to the individual patient. In particular, parameters like gain as a function of frequency, gain as a function of input level ("compression"), and volume have to be adjusted to the individual hearing loss and the individual preferences. Typically, hearing devices are fitted to a certain hearing loss using one of a plurality of known formulas (such as the NAL formula), so that for a given hearing loss the selected formula provides for a certain optimal setting of the hearing device parameters. Typically, the fitting formula seeks to optimize speech understanding.

However, when a patient wears the hearing device for the first time, the optimal parameter set as resulting from a fitting formula may create unpleasant hearing sensations to the patient. In particular, for some users, the transition from not wearing a hearing aid to wearing a hearing aid may be traumatic, when sounds that the patient is not accustomed to hearing are suddenly made audible by the hearing device. Thus, the patient's hearing needs some time to get accustomed to the new hearing sensations enabled by the use of the hearing device.

In order to address this problem, it is known to provide for an "acclimatization period" during which the parameter settings are gradually adjusted towards the optimal setting. For example, the applied gain may be gradually increased during the acclimatization period in order to gradually adjust the patient's experience from an uncompensated hearing level to a fully compensated hearing level. As an example of such acclimatization US 2011/0249839 A1 may be mentioned, which relates to a hearing aid, wherein the processor is configured to supply a selected one of a sequence of incremental hearing corrections to the audio signal captured by the microphone. Another example of a hearing aid using an automatic acclimatization process is known from WO 2009/144056 A1, wherein a smooth transition from an initial parameter setting, which is particularly pleasant to the patient, to a final parameter setting, which enables optimal speech recognition, is realized.

A further example of a hearing aid system utilizing an acclimatization process is described in US 2012/0243693 A1, which system may be implemented as a binaural system, wherein the acclimatization stages are synchronized between the two hearing aids by wireless communication between the two hearing aids; the respective acclimatization stage is determined by the time the hearing aid has been used so far. A typical duration of an acclimatization period is several months.

It is an object of the invention to provide for a fitting method of a binaural hearing system for a patient with asymmetric hearing loss, wherein unpleasant hearing sensations should be avoided as far as possible while nevertheless achieving satisfactory hearing compensation.

According to the invention, this object is achieved by a fitting method as defined in claim 1.

The invention is beneficial in that, by using an initial gain setting of the hearing device used with the ear having the stronger hearing loss is, on average in a main frequency range, lower than the respective final gain setting by an amount depending on the hearing loss of the ear having the weaker hearing loss, wherein the initial gain setting of the hearing device used with the ear having the weaker hearing loss deviates, on average in the main frequency range, from the respective final gain setting by an amount depending on the hearing loss of the ear having the stronger hearing loss, discomfort resulting from an unbalanced and too loud hearing impression and reduced intelligibility due to high amplification in the ear having the stronger hearing loss which may mask the ear having the weaker hearing loss can be avoided for first time users of the hearing devices. In particular, a more symmetrical gain setting, requiring less initial gain for the ear having the stronger hearing loss compared to the desired final gain setting, was found to have a better acceptance by first time users than the more asymmetric gain setting typically applied in a final stage of the fitting. In other words, hearing device acceptance by first time users can be enhanced by the present invention which proposes a more symmetrical initial gain setting, compared to the more asymmetrical final gain setting which would result from a conventional fitting process not taking into account the hearing loss of the other ear.

Preferably, the initial gain setting of the hearing device used with the ear having the weaker hearing loss is, at least in the main frequency range, higher than the respective final gain setting by an amount depending on the hearing loss of the ear having the stronger hearing loss.

Typically, the binaural difference of the initial gain settings of the two hearing devices, on average in the main frequency range, is less than 40 dB, preferably less than 20 dB, and more preferably less than 10 dB.

Preferably, the binaural asymmetry in the initial gain settings of the two hearing devices (in dB) is not more than half of the binaural asymmetry of the hearing loss (in dB), on average in the main frequency range.

Typically, the gain setting comprises the insertion gain.

Preferably, the change of the gain settings during the acclimatization period is controlled automatically by the hearing devices and preferably is binaurally synchronized by binaural communication of the two hearing devices.

Typically, the initial gain settings and the final gain settings are determined automatically by a fitting software.

Hereinafter, examples of the invention will be illustrated by reference to the attached drawings, wherein.

Figure 1:
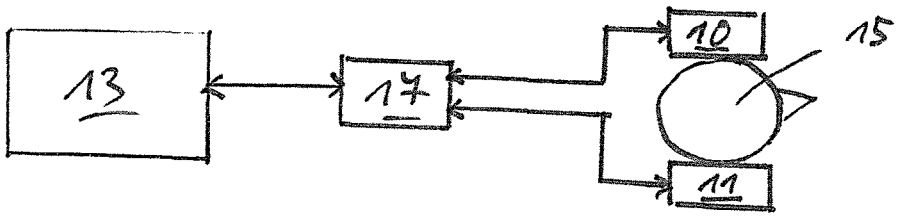
FIG. 1 is a schematic representation of an example of an arrangement for fitting of a binaural hearing system, which may be used with the present invention.

In FIG. 1 an arrangement for fitting of a binaural hearing system is shown schematically. The binaural hearing system comprises a first hearing device 10 to be worn at one ear, for example the right ear, of a patient 15 and a second hearing device 11 worn at the other, i.e. left, ear of the patient 15. Hereinafter, "hearing devices" are meant to include all kind of ear level audio devices which require an individual fitting to the user depending on the hearing loss of the user, such as hearing aids in different form factors or cochlea implants. The arrangement further comprises a fitting/programing unit 13, which may be implemented as a computer, and a programing interface 17. The programing unit 13 communicates with the hearing devices 10, 11 via the programming interface 17, which may be implemented as a wired or wireless connection. It is to be understood that the programing unit 13 is used with the hearing devices 10, 12 only for adjustment/fitting, but not during normal operation of the hearing devices 10, 11. Typically, the hearing devices 10, 11 are configured to communicate with each other via a wireless binaural link 30.

Figure 2:
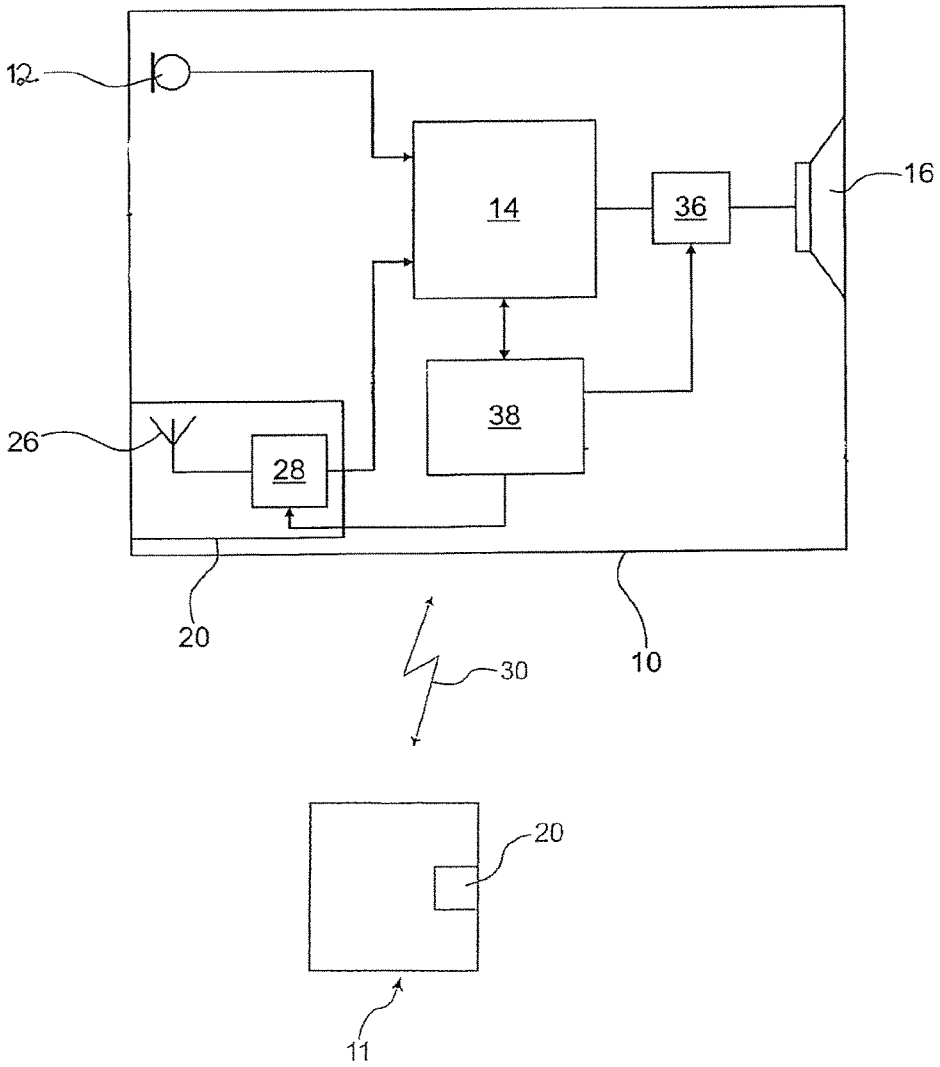
FIG. 2 is a block diagram of an example of a hearing device to be used with the present invention.

FIG. 2 is a block diagram of an example of a binaural hearing system comprising a first hearing device 10 to be worn at one ear of a user and a second hearing device 11 to be worn at the other ear of the user. The first and second hearing devices 10, 11 are ear level devices and together form a binaural hearing system. Preferably, the hearing devices 10, 11 are hearing instruments, such as RIC (Receiver in the canal), BTE (behind-the-ear), ITE (in-the-ear), ITC (in the canal) or CIC (completely-in-the-canal) hearing aids. However, the hearing devices, for example, also could be an auditory prosthesis, such as a cochlear implant device comprising an implanted cochlear stimulator and an external sound processor which may be designed as a BTE unit with a headpiece or as an integrated headpiece.

In the example of FIG. 2, the hearing devices 10, 11 are hearing aids comprising a microphone arrangement 12 for capturing audio signals from ambient sound, an audio signal processing unit 14 for processing the captured audio signals and an electro-acoustic output transducer (loudspeaker) 16 for stimulation of the user's hearing according to the processed audio signals (these elements are shown in FIG. 2 only for the hearing aid 10). For example, the audio signal processing in the unit 14 may include acoustic beamforming (in this case, the microphone arrangement 12 comprises at least two spaced apart microphones).

The hearing aids 10, 11 comprise a wireless interface 20 comprising an antenna 26 and a transceiver 28. The interface 20 is provided for enabling wireless data exchange between the first hearing aid 10 and the second hearing aid 11 via a wireless link 30 which serves to realize a binaural hearing assistance system, allowing the hearing aids 10, 11 to exchange audio signals and/or control data and status data, such as the present settings of the hearing aids 10, 11.

The interface 20 may also be provided for data exchange via a wireless link 30 from or to an external device (not shown), for example for receiving an audio data stream from an external device acting as an audio source, or data from a remote control device. In particular, the interface 20 also may be used for wirelessly connecting the hearing devices 10, 11 with the programming interface 17.

For example, the interface 20 may be adapted to operate at frequencies around 2.4 GHz in the ISM band, or in any other suitable frequency range, such as up to 10 GHz. Typically, the interface 20 is a Bluetooth interface, such as a Bluetooth Smart or a Bluetooth Smart Ready interface; alternatively, it may use another standard protocol, or it may be a proprietary interface.

For speech intelligibility certain frequencies are more relevant than others. Accordingly, a frequency range from 500 Hz and 4 kHz hereinafter will be referred to as a "main frequency range" which is primarily considered for evaluating the hearing loss of the patient and for the gain settings of the hearing devices 10, 11. Typically, an average, such as a linear average, of the respective parameter over the main frequency range is considered.

The present invention primarily is to be applied to patients having a pronounced asymmetric hearing loss, namely a hearing loss wherein the difference in hearing loss between the two ears is at least 5 dB on average in the main frequency range; preferably, the difference is at least 20 dB.

Figure 3:
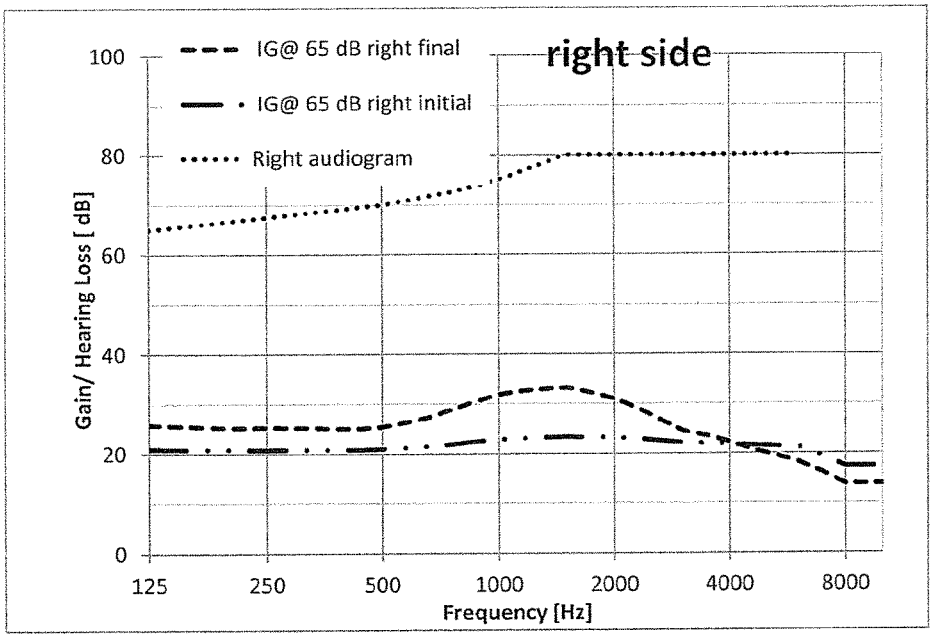
FIG. 3 is an example of a diagram of the hearing loss of the right ear of a patient and of the insertion gain at an input sound pressure level of 65 dB as a function of frequency according to an initial setting and a final setting.
Figure 4:
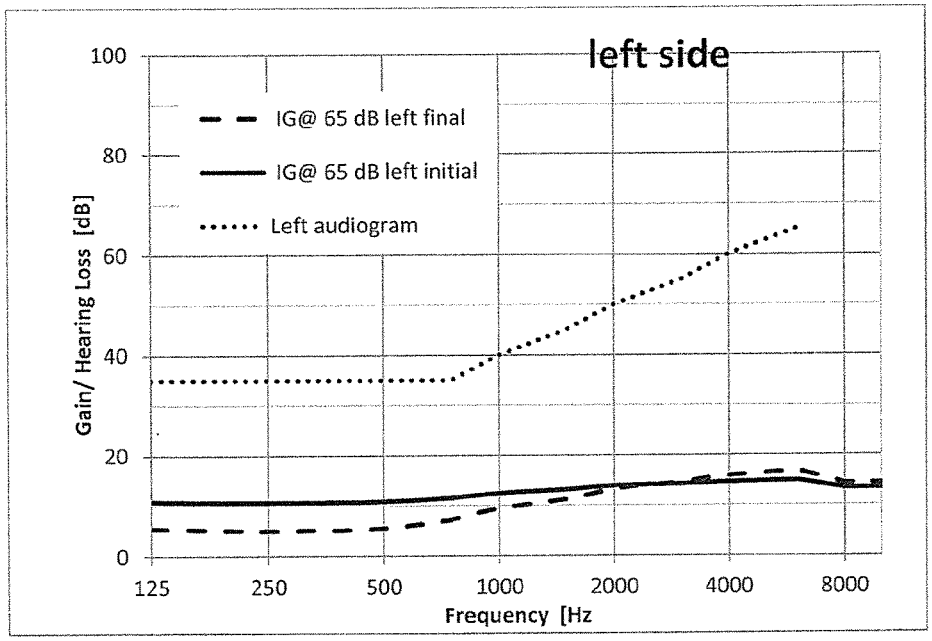
FIG. 4 is a diagram like FIG. 3, but for the left ear.

In FIGS. 3 and 4 an example of an asymmetric hearing loss of a patient is shown as a function of frequency. It can be seen that the right ear of the patient suffers from a relatively strong hearing loss across the entire relevant frequency range from 125 Hz to 6000 Hz, whereas the left ear has a relatively mild hearing loss at frequencies below 1000 Hz which increases for higher frequencies. Thus, the left ear of the patient may be considered as the "strong ear", whereas the right ear may be considered as the "weak ear" of that patient.

From such individual hearing loss data the fitting/programing unit 13 may calculate, e.g. by using one of the standard formulas, the desired final gain setting for each of the two hearing devices 10, 11 which is suitable for optimally compensating the hearing loss. An example of the result of such calculation is shown in FIGS. 3 and 4, wherein the insertion gain is shown as a function of frequency. It can be seen in FIG. 5 that such final gain setting is significantly higher for the weaker right ear, namely about 20 dB at lower frequencies below 2000 Hz.

However, the final gain setting is applied in the respective hearing devices 10, 11 only after a certain acclimatization period has expired. The duration of the acclimatization period typically is at least one month and may be up to several months. While the final gain setting is optimized with regard to speech intelligibility, it typically is not suitable for an unexperienced hearing device user using a hearing device for the first time. For example, typically a first time user feels that the optimized final gain setting results in a too loud hearing impression.

Thus, in order to avoid unpleasant hearing sensations, which even may result in rejection of the hearing device by the user, an initial gain setting is selected at the beginning of the acclimatization period, so that the user may become accustomed to the final gain setting by gradual adjustment of the gain setting from the initial setting to the final setting during the acclimatization period. This is particularly important in case of a pronounced asymmetric hearing loss.

In this regard, it was found by the inventors that it is particularly important to determine the initial gain setting for each hearing device based on the hearing loss of both ears (and not only based on the hearing loss of that ear at which the hearing device is used).

More in detail, the initial gain settings should be more "balanced" than the final gain settings, i.e. the binaural difference between the initial gain settings, on average in the main frequency range, should be lower than that of the final gain settings. In particular, the initial gain setting of the hearing device to be used with the weaker ear, on average in the main frequency range, should be lower than the respective final gain setting by an amount depending on the hearing loss of the better ear. Further, the initial gain setting of the hearing device used with the better ear should deviate, on average in the main frequency range, from the respective final gain setting by an amount depending on the hearing loss of the weaker ear; typically, the deviation would be such that the initial gain setting of the hearing device used with the better ear should be higher than the respective final gain setting by an amount depending on the hearing loss of the weaker ear.

Typically, the gain settings relate to the insertion gain. For example, the binaural difference between the initial insertion gain settings, on average in the main frequency range, typically is lower than that of the final insertion gain settings by at least 3 dB, preferably by at least 10 dB. Typically, the difference in the initial insertion gain setting of the two hearing devices, on average in the main frequency range, is less than 40 dB, preferably less than 20 dB, and more preferably less than 10 dB. Preferably, the binaural asymmetry in the initial gain settings of the two hearing devices (in dB) is not more than half (or more preferably not more than one third) of the binaural asymmetry of the hearing loss (in dB), on average in the main frequency range; for example, for a binaural difference of the hearing loss of 20 dB, the binaural difference of the initial gain setting then would be less than 10 dB.

Typically, for both hearing devices the initial insertion gain setting, on average in the main frequency range, is in the range of from 0 to 80 dB.

Figure 5:
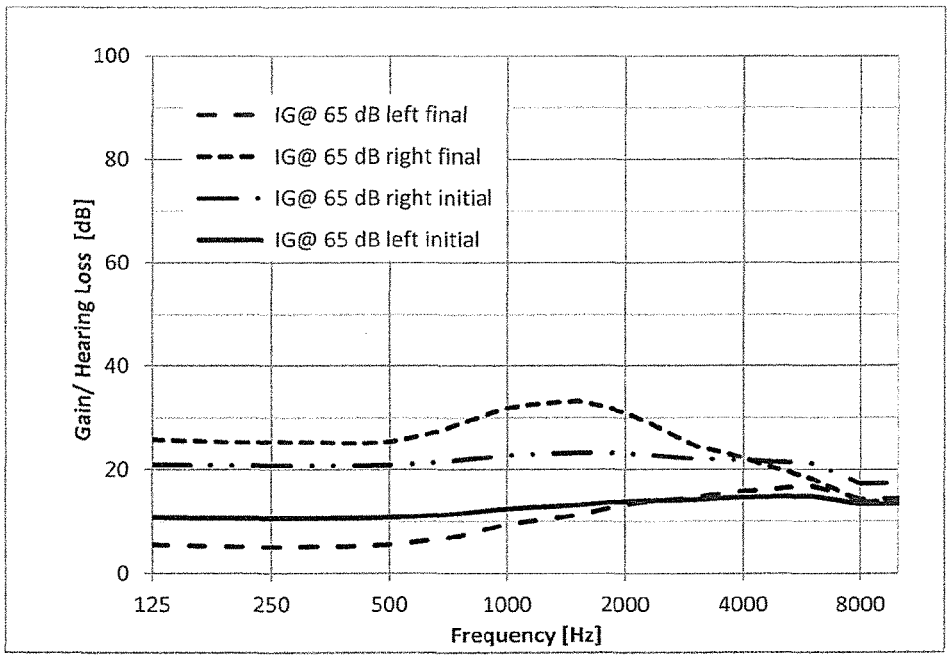
FIG. 5 is a diagram which combines, for comparison, the initial and final gain settings of the right ear hearing device and the left ear hearing device.

In the example shown in FIGS. 3 to 5, the initial insertion gain setting for the weaker ear is about 5 to 10 dB lower than the respective final insertion gain setting for frequencies below 2000 Hz, whereas the initial insertion gain setting for the better ear is about 5 dB higher than the respective final insertion gain setting for frequencies below 2000 Hz, so that the binaural difference in the initial insertion gain settings is about 10 dB, whereas the binaural difference between the final insertion gain settings is about 20 dB for frequencies below 2000 Hz, i.e. the binaural difference in the insertion gain settings is reduced by about 10 dB in the initial setting compared to the final setting.

Preferably, the final gain settings and the initial gain settings are determined automatically, such as by a respective fitting software running on the fitting/programming unit 13. However, according to some examples, the initial gain settings and/or the final gain settings may be determined manually.

Preferably, the change of the gain settings during the acclimatization period is controlled automatically by appropriate programing of the hearing devices 10, 11; in particular, the change of the gain settings during the acclimatization period may be binaurally synchronized by communication of the two hearing devices 10, 11 via the binaural link 30. However, in principle it is also possible to have a manual adjustment of the gain settings during the acclimatization period.

The concept of binaural equalization of gain in asymmetric hearing loss in principle could be applied also without the need for an acclimatization process during which the gain settings approach final gain settings which are binaurally more asymmetric than the initial gain settings. In other words, also in "static" cases it may be beneficial to reduce the binaural asymmetry of the gain settings which would result from a conventional "monaural" fitting approach which determines the gain for each ear without taking into account the hearing loss of the other (contralateral) ear.

In such static cases, the binaural difference in the insertion gain settings of the two hearing devices, in dB, preferably is not more than half (or more preferably not more than one third) of the binaural difference of the hearing loss, in dB, on average in the main frequency range. Typically, the difference in the insertion gain setting of the two hearing devices, on average in the main frequency range, would be less than 40 dB, preferably less than 20 dB, and more preferably less than 10 dB.

The insertion gain setting of the hearing device used at the ear having the stronger hearing loss is, on average in the main frequency range, lower than the conventional "monaural" gain setting by an amount depending on the hearing loss of the ear having the weaker hearing loss, and the insertion gain setting of the hearing device used at the ear having the weaker hearing loss deviates, on average in the main frequency range, from the conventional "monaural" gain setting by an amount depending on the hearing loss of the ear having the stronger hearing loss (usually, the insertion setting of the hearing device used at the ear having the weaker hearing loss is, on average in the main frequency range, higher than the conventional "monaural" gain setting by an amount depending on the hearing loss of the ear having the stronger hearing loss).

The invention claimed is:

1. A method for fitting of a binaural hearing system comprising a first hearing device and a second hearing device to a patient suffering from an asymmetric hearing loss for first time use, wherein the difference in hearing loss between the two ears is at least 5 dB on average in a main frequency range between 500 Hz and 4 kHz, the method comprising:

providing audiogram data representative of the hearing loss of each of the ears of the patient, determining, from the audiogram data, for each of the hearing devices an initial gain setting and a final gain setting, applying, for an initial time period, the respective initial gain setting to each of the hearing devices, applying, for an acclimatization time period, gain settings to each of the hearing device which are gradually changed, as a function of time, from the respective initial gain setting to the respective final gain setting, applying, after lapse of the acclimatization time period, the respective final gain setting in each of the hearing devices, wherein the initial gain setting of the hearing device used at the ear having the stronger hearing loss is, on average in the main frequency range, lower than the respective final gain setting by an amount depending on the hearing loss of the ear having the weaker hearing loss, wherein the initial gain setting of the hearing device used at the ear having the weaker hearing loss deviates, on average in the main frequency range, from the respective final gain setting by an amount depending on the hearing loss of the ear having the stronger hearing loss, and wherein, on average in the main frequency range, the binaural difference between the initial gain settings is lower than that of the final gain settings.

2. The method of claim 1, wherein the initial gain setting of the hearing device used at the ear having the weaker hearing loss is, on average in the main frequency range, higher than the respective final gain setting by an amount depending on the hearing loss of the ear having the stronger hearing loss.

3. The method of claim 1, wherein the gain settings comprise an insertion gain.

4. The method of claim 3, wherein, on average in the main frequency range, the binaural difference between the initial gain settings is lower than the binaural difference between the final gain settings by at least 3 dB.

5. The method of claim 4, wherein, on average in the main frequency range, the binaural difference between the initial gain settings is lower than the binaural difference between the final gain settings by at least 10 dB.

6. The method of claim 3, wherein, on average in the main frequency range, the binaural difference between the initial gain settings is less than 40 dB.

7. The method of claim 6, wherein, on average in the main frequency range, the binaural difference between the initial gain settings is less than 20 dB.

8. The method of claim 7, wherein, on average in the main frequency range, the binaural difference between the initial gain settings is less than 10 dB.

9. The method of claim 1, wherein the difference in hearing loss between the two ears is at least 20 dB on average in the main frequency range.

10. The method of claim 1, wherein, the binaural difference in the initial gain settings of the two hearing devices, in dB, is not more than half of the binaural difference of the hearing loss, in dB, on average in the main frequency range.

11. The method of claim 1, wherein the change of the gain settings during the acclimatization period is controlled automatically.

12. The method of claim 11, wherein the change of the gain settings during the acclimatization period is binaurally synchronized by binaural communication of the hearing devices.

13. The method of claim 1, wherein the initial gain settings and the final gain settings are determined automatically.

14. The method of claim 1, wherein the hearing devices are hearing aids.

15. The method of claim 1, wherein the duration of the acclimatization period is at least one month.

* * * * *